US009638139B2

(12) United States Patent
Ryan et al.

(10) Patent No.: US 9,638,139 B2
(45) Date of Patent: May 2, 2017

(54) ENGINE WITH COOLANT THROTTLE AND METHOD FOR CONTROLLING THE SAME

(75) Inventors: Steven M. Ryan, Villa Park, IL (US); Steven J. Dickerson, Lake in the Hills, IL (US)

(73) Assignee: International Engine Intellectual Property, LLC., Lisle, IL (US)

( * ) Notice: Subject to any disclaimer, the term of this patent is extended or adjusted under 35 U.S.C. 154(b) by 480 days.

(21) Appl. No.: 13/702,065

(22) PCT Filed: Jun. 4, 2010

(86) PCT No.: PCT/US2010/037360

§ 371 (c)(1),
(2), (4) Date: Mar. 18, 2013

(87) PCT Pub. No.: WO2011/152827

PCT Pub. Date: Dec. 8, 2011

(65) Prior Publication Data

US 2013/0186377 A1 Jul. 25, 2013

(51) Int. Cl.

| | |
|---|---|
| ***F02M 25/07*** | (2006.01) |
| ***F01P 3/12*** | (2006.01) |
| ***F01P 7/16*** | (2006.01) |
| ***F02M 26/22*** | (2016.01) |

(52) U.S. Cl.

CPC ..... *F02M 25/0726* (2013.01); *F01P 3/12* (2013.01); *F01P 7/167* (2013.01); *F02M 26/22* (2016.02); *F01P 2060/02* (2013.01)

(58) Field of Classification Search

USPC ..... 123/41.79, 193.5, 568.13, FOR. 126, 123/568.11, 568.16, 568.18, 568.1, 9, 123/568.2, 568.23, 568.24–568.26, 406.48

See application file for complete search history.

(56) References Cited

U.S. PATENT DOCUMENTS

| | | | | |
|---|---|---|---|---|
| 6,422,181 | B1 * | 7/2002 | Ovari | 123/41.1 |
| 7,143,580 | B2 * | 12/2006 | Ge | 60/605.1 |
| 7,299,771 | B2 | 11/2007 | Wei | |
| 7,418,825 | B1 * | 9/2008 | Bean, Jr. | 62/259.2 |
| 2007/0089717 | A1 | 4/2007 | Saele | |
| 2007/0157893 | A1 | 7/2007 | Wei | |
| 2008/0115747 | A1 * | 5/2008 | Snyder et al. | 123/41.31 |

* cited by examiner

*Primary Examiner* — Hung Q Nguyen
*Assistant Examiner* — Ruben Picon-Feliciano
(74) *Attorney, Agent, or Firm* — Jack D. Nimz; Jeffrey P. Calfa

(57) ABSTRACT

A method of controlling cooling flow through a coolant system of an internal combustion engine having an electronic control module, a cooling throttle, an EGR cooler, and an interstage cooler is provided. A pressure within a coolant system is determined. A temperature within the coolant system is determined. A temperature of exhaust gas exiting an EGR cooler is determined. A temperature of intake air exiting an interstage cooler is determined. A position of a cooling throttle within the coolant system is adjusted based upon at least one of the determined pressure within the coolant system, temperature within the coolant system, temperature of exhaust gas exiting the EGR cooler, and temperature of intake air exiting an interstage cooler being above respective predefined thresholds to adjust fluid flow within the coolant system.

1 Claim, 2 Drawing Sheets

ENGINE WITH COOLANT THROTTLE AND METHOD FOR CONTROLLING THE SAME

TECHNICAL FIELD

The present disclosure relates to an engine having a coolant throttle, and more particularly to an engine having a coolant throttle that is utilized to control pressure within a cooling system to prevent damage to a radiator.

BACKGROUND

Engine coolant may be utilized to control the temperature of a variety of engine components including portions of an engine block, portions of a cylinder head, an exhaust gas recirculation (EGR) cooler, and an interstage cooler located between two compressors of the air intake system. Several of these components, such as the EGR cooler and the interstage cooler, transfer a large amount of heat into the cooling system, requiring vehicles to have higher cooling flow rates, in order to maintain appropriate operating temperatures. However, these higher cooling flow rates are only needed during certain operating conditions. Therefore, a need exists for a cooling system with a coolant throttle to control the flow rate, and therefore the pressure, within a cooling system.

SUMMARY

According to one embodiment, an engine cooling system for an internal combustion engine comprises an electronic control module, a cooling throttle, a pressure sensor, a first temperature sensor, and a second temperature sensor. The cooling throttle is positionable between an open position and a closed position. The cooling throttle is disposed in fluid communication with the cooling system. The cooling throttle controls a flow rate of coolant within the cooling system. The cooling throttle is disposed in communication with the electronic control module. The pressure sensor is disposed in fluid communication with the cooling system. The pressure sensor is disposed in communication with the electronic control module. The pressure sensor generates an output to the electronic control module. The first temperature sensor is disposed in fluid communication with the cooling system. The first temperature sensor is disposed in communication with the electronic control module. The first temperature sensor generates an output to the electronic control module. The second temperature sensor is disposed in fluid communication with exhaust gas downstream of an EGR cooler. The second temperature sensor is disposed in communication with the electronic control module. The second temperature sensor generates an output to the electronic control module. Wherein the electronic control module generates an output to adjust the position of the cooling throttle based upon at least one of the outputs of the pressure sensor, the first temperature sensor, and the second temperature sensor.

According to one process, a method of controlling cooling flow through a coolant system of an internal combustion engine having an electronic control module, a cooling throttle, an EGR cooler, and an interstage cooler is provided. A pressure within a coolant system is determined. A temperature within the coolant system is determined. A temperature of exhaust gas exiting an EGR cooler is determined. A temperature of intake air exiting an interstage cooler is determined. A position of a cooling throttle within the coolant system is adjusted based upon at least one of the determined pressure within the coolant system, temperature within the coolant system, temperature of exhaust gas exiting the EGR cooler, and temperature of intake air exiting an interstage cooler being above respective predefined thresholds to adjust fluid flow within the coolant system.

According to another process, a method of controlling cooling flow through a coolant system of an internal combustion engine having an electronic control module, a cooling throttle, an EGR cooler, and an interstage cooler is provided. A pressure within a coolant system is determined. The pressure within the coolant system is compared to a predefined coolant system pressure threshold stored within an electronic control module. A temperature within the coolant system is determined. The temperature within the coolant system is compared to a predefined coolant temperature threshold stored within the electronic control module. A temperature of exhaust gas exiting an EGR cooler is determined. The temperature of the exhaust gas exiting the EGR cooler is compared to a predefined exhaust gas temperature threshold stored within the electronic control module. A position of a cooling throttle within the coolant system is adjusted if at least one of the pressure within the coolant system exceeds the predefined coolant system pressure threshold, the temperature within the coolant system exceeds the predefined coolant temperature threshold, and the temperature of the exhaust gas exiting the EGR cooler exceeds the predefined exhaust gas temperature threshold.

DETAILED DESCRIPTION

Figure 1:
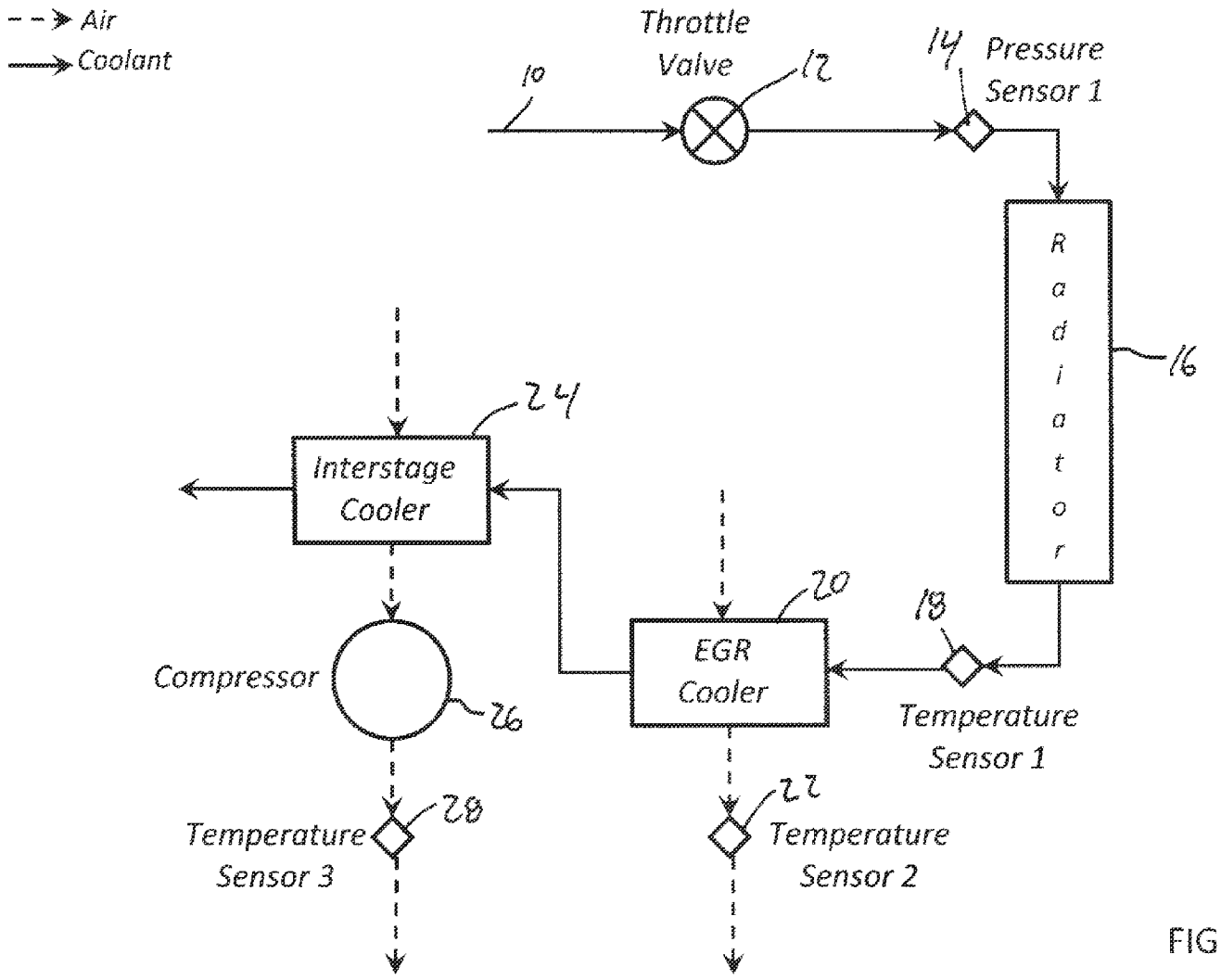
FIG. 1 is a schematic diagram showing a portion of an engine cooling system for an engine having a coolant throttle to control cooling flow through the cooling system.

FIG. 1 shows a portion of a cooling system 10 for an internal combustion engine, the cooling system 10 having a cooling throttle 12. The cooling throttle 12 is positionable between an open position and a closed position to regulate a flow rate of coolant within the cooling system 10. It is contemplated that the cooling throttle may be positioned at a variety of positions between the open position and the closed position to regulate the flow arte of the cooling system 10. The position of the cooling throttle 12 is controlled by an electronic control module (ECM). The cooling system 10 additionally comprises a pressure sensor 14. The pressure sensor 14 is located near an inlet of a radiator 16 and is disposed in fluid communication with the cooling system 10. The pressure sensor 14 generates an output indicative of the pressure within the cooling system 10. The pressure sensor 14 is also disposed in communication with the ECM. The output of the pressure sensor 14 is utilized by the ECM to determine if the pressure within the cooling system 10 is above a predefined pressure limit. If the output of the pressure sensor 14 indicates that coolant within the cooling system 10 is above the predefined pressure limit, the cooling throttle 12 may be closed to reduce a coolant flow rate, and thereby reduce the pressure of the coolant within the cooling system 10.

A first temperature sensor 18 is disposed in fluid communication with the cooling system 10 downstream of the radiator 16. The radiator 16 is adapted to be positioned within an air flow when the vehicle is moving, and may additionally have a fan near the radiator 16 to pull air through the radiator, in order to transfer heat from the coolant within the cooling system 10, to the air passing through the radiator. The first temperature sensor 18 generates an output indicative of the temperature of the coolant within the cooling system 10 after it has been cooled by the radiator 16. The first temperature sensor 18 is also disposed in communication with the ECM. The output of the first temperature sensor 18 is utilized by the ECM to determine if the radiator 16 is reducing the temperature of the coolant to a predefined range of operating temperatures. If the output of the first temperature sensor 18 indicates that coolant within the cooling system 10 that has passed through the radiator 16 is above a predefined temperature, the cooling throttle 12 may be opened to increase a coolant flow rate, and thereby reduce the temperature of the coolant flowing past the first temperature sensor 18.

The cooling system 10 additionally comprises an EGR cooler 20. The EGR cooler 20 receives coolant within the cooling system to reduce the temperature of exhaust gas passing through the EGR cooler 20, before that exhaust gas is fed into the air intake system of the engine to be mixed with fresh air and used for combustion. The EGR cooler 20 reduces the temperature of the exhaust gas to a level that allows the engine to function as intended. A second temperature sensor 22 is disposed in fluid communication with the exhaust gas passing through the EGR cooler. The second temperature sensor 22 is disposed downstream of the EGR cooler 20. The second temperature sensor 22 therefore may be used to determine if the exhaust gas is being cooled sufficiently by the EGR cooler 20, or if additional coolant flow is required through the EGR cooler 20. The second temperature sensor 22 is disposed in communication with the ECM. The output of the second temperature sensor 22 is utilized by the ECM to determine if the EGR cooler 20 is reducing the temperature of the exhaust gas to a predefined range of operating temperatures. If the output of the second temperature sensor 22 indicates that exhaust gas that has passed through the EGR cooler 20 is above a predefined temperature, the cooling throttle 12 may be opened to increase a coolant flow rate, and thereby reduce the temperature of the coolant flowing into the EGR cooler 20, thereby reducing the temperature of the exhaust gas flowing past the second temperature sensor 22.

The cooling system 10 further comprises an interstage cooler 24. The interstage cooler 24 receives coolant within the cooling system 10 to reduce the temperature of intake air passing through the interstage cooler 24, before that intake air enters into a compressor 26 of a turbocharger in an air intake system of the engine. The interstage cooler 24 reduces the temperature of the intake to a level that allows the engine to function as intended. A third temperature sensor 28 is disposed in fluid communication with the intake air passing through the interstage cooler 24 and the compressor 26. The third temperature sensor 28 is disposed downstream of the interstage cooler 24. The third temperature sensor 24 therefore may be used to determine if the intake air is being cooled sufficiently by the interstage cooler 24, or if additional coolant flow is required through the interstage cooler 24. The third temperature sensor 28 is disposed in communication with the ECM. The output of the third temperature sensor 28 is utilized by the ECM to determine if the interstage cooler 24 is reducing the temperature of the exhaust gas to a predefined range of operating temperatures. If the output of the third temperature sensor 28 indicates that intake air that has passed through the interstage cooler 24 is above a predefined temperature, the cooling throttle 12 may be opened to increase a coolant flow rate, and thereby reduce the temperature of the coolant flowing into the interstage cooler 24, thereby reducing the temperature of the intake air flowing past the third temperature sensor 28.

Figure 2:
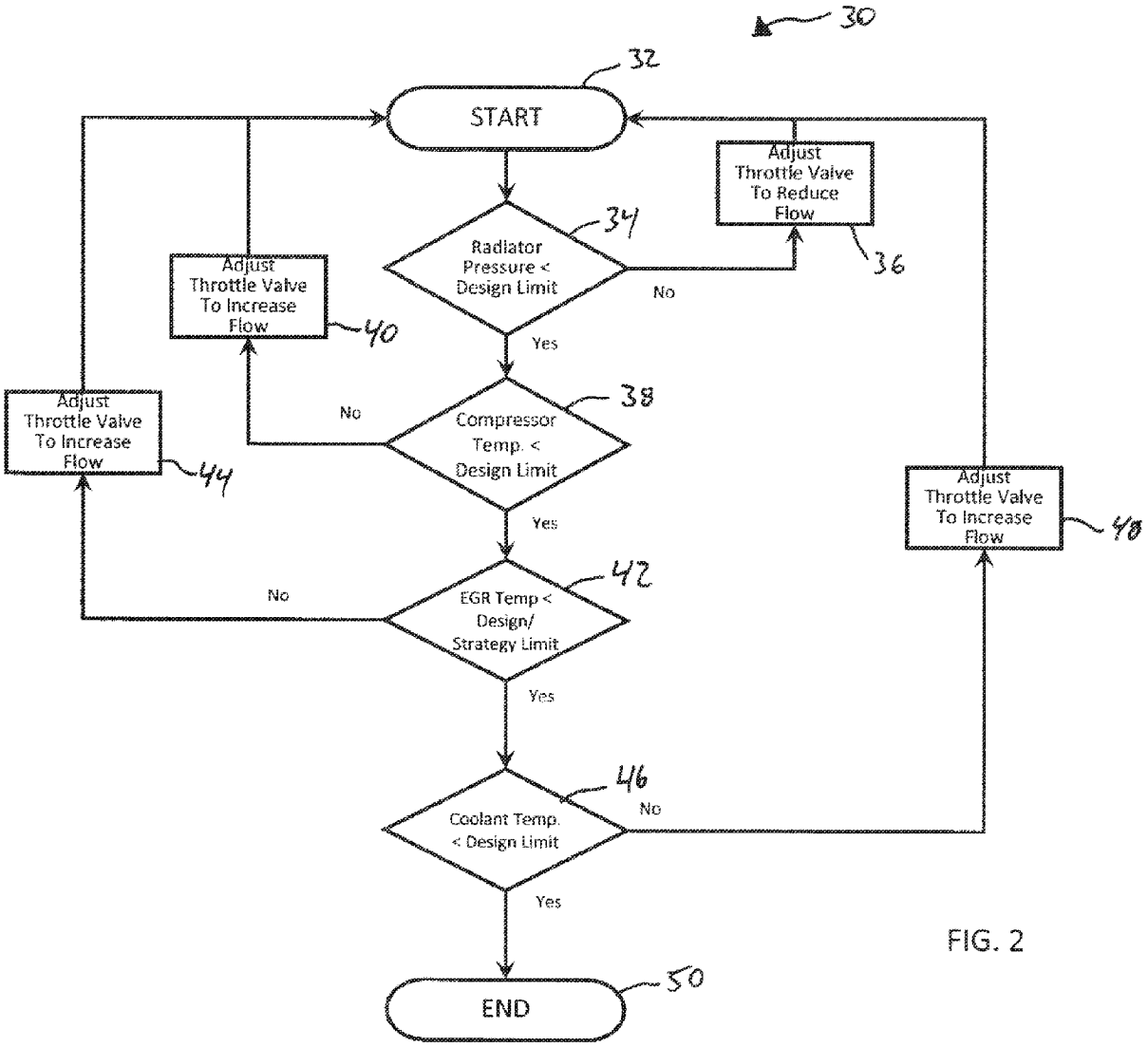
FIG. 2 is a flow chart showing one method of controlling a position of a coolant throttle.

Turning now to FIG. 2, a flow chart is shown depicting one process 30 of controlling the position of the cooling throttle 12. The process 30 of controlling the position of the cooling throttle 12 is initiated as shown at block 32. An output of the pressure sensor 14 of the cooling system 10 is compared to a predefined pressure limit value stored in the ECM at block 34. If the pressure within the cooling system 10 is above the predefined pressure limit, the cooling throttle 12 is moved to a more closed position to reduce the flow of coolant within the cooling system 10, and, consequently, reduce the pressure within the cooling system 10 as shown at block 36.

If the pressure is not above the predefined pressure limit, the method 30 determines if the temperature of intake air exiting a compressor 26 of a turbocharger is above a first predefined temperature limit, as shown at block 38. If the temperature of intake air exiting a compressor 26 of the turbocharger is above the first predefined temperature, the cooling throttle 12 is moved to a more open position to increase the flow of coolant through the cooling system 10 as shown at block 40.

If the temperature of intake air exiting a compressor 26 is not above the first predefined temperature, a temperature of exhaust gas exiting an EGR cooler 20 is compared to a second predefined temperature, as shown at block 42. If the temperature of exhaust gas exiting the EGR cooler 20 is above the second predefined temperature, the cooling throttle 12 is moved to a more open position, to increase the flow of coolant through the cooling system 10, as shown at block 44.

If the temperature of exhaust gas exiting the EGR cooler 20 is not above the second predefined temperature, a temperature of coolant within the cooling system 10 is compared to a third predefined temperature, as shown at block 46. If the temperature of coolant within the cooling system 10 is above the third predefined temperature, the cooling throttle 12 is moved to a more open position, to increase the flow of coolant through the cooling system 10, as shown at block 48. If the temperature of the coolant is not above the third predefined temperature, the method ends, as shown at block 50, and will be restarted at block 32 after a predefined period of time.

The method 30 therefore protects the cooling system 10 from operating at a pressure that is above the predefined pressure limit of the cooling system 10, while also ensuring that if the pressure is not above the predefined pressure limit, the temperature of coolant within the cooling system 10, the temperature of exhaust gas exiting the EGR cooler 20, and the temperature of intake air exiting a compressor 26 of the turbocharger may be controlled by adjusting coolant flow through a coolant throttle 12 to a more open position. If the pressure of the coolant system 10 is above the predefined pressure limit, and at least one of the temperature sensors indicates a temperature above a predefined limit, engine performance may be limited to prevent damage to the engine, or the cooling system 10 of the engine.

What is claimed is:

1. A method to control pressure of coolant within an engine cooling system for an internal combustion engine, comprising:

providing an electronic control module;

providing a cooling throttle positionable between an open position and a closed position, the cooling throttle being disposed in fluid communication with the cooling system and in communication with the electronic control module, the cooling throttle being provided for controlling a flow rate of coolant within the cooling system;

providing a radiator for transferring heat from the coolant within the cooling system to cool the coolant;

providing a pressure sensor disposed in fluid communication with the radiator, the pressure sensor disposed in communication with the electronic control module, the pressure sensor generating an output to the electronic control module indicative of the pressure within the radiator;

providing a first temperature sensor disposed in fluid communication with the coolant after it has been cooled by the radiator, the first temperature sensor disposed in communication with the electronic control module and generating an output to the electronic control module indicative of the temperature of the coolant within the cooling system after it has been cooled by the radiator;

providing an EGR cooler disposed downstream of the radiator for cooling recirculated exhaust gases from the engine passing through the EGR cooler;

providing a second temperature sensor disposed in fluid communication with exhaust gas downstream of the EGR cooler, the second temperature sensor disposed in communication with the electronic control module and generating an output to the electronic control module indicative of the temperature of the exhaust gas downstream of the EGR cooler;

providing a third temperature sensor disposed in fluid communication with the air downstream of the compressor, the third temperature sensor disposed in communication with the electronic control module and generating an output to the electronic control module indicative of the temperature of the air downstream of the compressor; and wherein the electronic control module generates an output to adjust the position of the cooling throttle based:

first, upon the output of the pressure sensor, with the coolant throttle moved toward its closed position if the pressure is above a predetermined pressure limit;

second, if the pressure sensor is not above the predetermined pressure limit, whether the third temperature sensor is above a third predetermined temperature limit, with the coolant throttle moved toward its open position if the pressure sensor is not above the predetermined pressure and the third temperature sensor is above the third predetermined temperature limit—and the coolant throttle moved toward its closed position if the pressure sensor is not above the predetermined pressure limit and the third temperature sensor is above the third predetermined temperature limit;

third, if the pressure sensor is not above the predetermine pressure limit, and the third temperature sensor is above the third predetermined temperature limit, whether the second temperature sensor is above a second predetermined temperature limit, with the coolant throttle moved toward its open position if the pressure sensor is not above the predetermined pressure limit, and the third temperature sensor is above the third predetermined temperature limit, and the second temperature sensor is above the second predetermined temperature limit—and the coolant throttle moved toward its closed position if the pressure sensor is not above the predetermined pressure limit, the third temperature sensor is above the third predetermined temperature limit, and the second temperature sensor is above the second predetermined temperature limit.

* * * * *